US010709956B1

(12) United States Patent
Liang et al.

(10) Patent No.: US 10,709,956 B1
(45) Date of Patent: Jul. 14, 2020

(54) MULTIPLAYER SPORTS FORMATION ARRANGEMENT PROMPTING METHOD AND SYSTEM

(71) Applicant: Industrial Technology Research Institute, Hsinchu (TW)

(72) Inventors: Min-Hsiung Liang, Taichung (TW); Yen-Ting Wu, Taoyuan (TW); Wei-Yuan Cheng, Hsinchu County (TW); Ming-Huan Yang, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 16/354,163

(22) Filed: Mar. 14, 2019

(30) Foreign Application Priority Data

Feb. 27, 2019 (TW) ..... 108106853 A

(51) Int. Cl.
*A63F 9/00* (2006.01)
*A63B 71/06* (2006.01)

(52) U.S. Cl.
CPC ..... *A63B 71/0619* (2013.01); *A63B 2220/18* (2013.01); *A63B 2220/40* (2013.01); *A63B 2220/72* (2013.01); *A63B 2220/75* (2013.01); *A63B 2220/76* (2013.01); *A63B 2220/833* (2013.01); *A63B 2220/836* (2013.01); *A63B 2225/50* (2013.01); *A63B 2225/54* (2013.01); *A63B 2230/04* (2013.01); *A63B 2230/08* (2013.01); *A63B 2230/20* (2013.01); *A63B 2230/30* (2013.01); *A63B 2230/40* (2013.01);
(Continued)

(58) Field of Classification Search
None
See application file for complete search history.

(56) References Cited

U.S. PATENT DOCUMENTS

| | | | | |
|---|---|---|---|---|
| 10,025,987 | B2 | 7/2018 | Ackland et al. | |
| 2007/0021879 | A1 | 1/2007 | DelNero et al. | |
| 2010/0198453 | A1* | 8/2010 | Dorogusker | A61B 5/11 701/31.4 |

FOREIGN PATENT DOCUMENTS

| | | |
|---|---|---|
| CN | 107168329 | 9/2017 |
| TW | I479920 | 4/2015 |

(Continued)

*Primary Examiner* — Seng H Lim
(74) *Attorney, Agent, or Firm* — JCIPRNET

(57) ABSTRACT

A multiplayer sports formation arrangement prompting method adapted to monitor, by a computing device, a formation of a plurality of athletes participating in a multiplayer sport to prompt each of the athletes to adjust a position is provided, in which at least two wind sensors and a positioning device are disposed on or around each of the athletes. In this method, relative positions of the athletes with respect to each other are detected by using the positioning device, a wind direction is detected by using the at least two wind sensors disposed on or around a first athlete of the athletes, a second athlete behind the first athlete is prompted to adjust the position to enter a low wind resistance zone according to the relative position of the first athlete with respect to the second athlete and the detected wind direction, and the second athlete is prompted to adjust a position within the low wind resistance zone based on values detected by the at least two wind sensors disposed on or around the second athlete.

20 Claims, 12 Drawing Sheets

(52) U.S. Cl.
CPC ..... *A63B 2230/50* (2013.01); *A63B 2244/186* (2013.01)

(56) References Cited

FOREIGN PATENT DOCUMENTS

| | | |
|---|---|---|
| TW | I537771 | 6/2016 |
| TW | M560062 | 5/2018 |

* cited by examiner

MULTIPLAYER SPORTS FORMATION ARRANGEMENT PROMPTING METHOD AND SYSTEM

CROSS-REFERENCE TO RELATED APPLICATION

This application claims the priority benefit of Taiwan application no. 108106853, filed on Feb. 27, 2019. The entirety of the above-mentioned patent application is hereby incorporated by reference herein.

TECHNICAL FIELD

The disclosure relates to multiplayer sports formation arrangement prompting method and system.

BACKGROUND

With the awareness of physical exercise increased each day, cycling, running, and roller-blading have become popular racing sports nowadays. In various racing events, as the environment and tactics change, athletes in the same team needs to adjust their own position and velocity accordingly. However, due to different perceptions from the athletes, a tactical formation may not be formed perfectly. Further, currently, the athletes can only adjust the formation based on information like wind direction, velocity and power together with their own experience without actually having other data for reference or comparison.

Based on the above, because of the mistaken judgment, the athletes in the team often fail to be adjusted to the correct position and velocity in response to changes in the environment and tactics. Therefore, how to provide the data for the athletes in the team immediately according to the current environment and tactics so the position and velocity of each athlete in the team can be adjusted is the direction that the person in the art is devoted to research.

SUMMARY

An embodiment of the disclosure provides a multiplayer sports formation arrangement prompting method adapted to monitor, by a computing device, a formation of a plurality of athletes participating in a multiplayer sport to prompt each of the athletes to adjust a position. Here, at least two wind sensors and a positioning device are disposed on each of the athletes. The method includes the following steps: detecting relative positions of the athletes with respect to each other by using the positioning device; detecting a wind direction by using the at least two wind sensors disposed on or around a first athlete of the athletes; prompting a second athlete behind the first athlete to adjust the position to enter a low wind resistance zone according to the relative position of the first athlete with respect to the second athlete and the detected wind direction; and prompting the second athlete to adjust a position within the low wind resistance zone based on values detected by the at least two wind sensors disposed on or around the second athlete.

An embodiment of the disclosure provides a multiplayer sports formation arrangement prompting system, including: at least two wind sensors and a positioning device disposed on each athlete of a plurality of athletes participating in a multiplayer sport; and a computing device, connected to and communicated with the wind sensors and the positioning device, and configured to: detect relative positions of the athletes with respect to each other by using the positioning device; detect a wind direction by using the at least two wind sensors disposed on or around a first athlete of the athletes; prompt a second athlete behind the first athlete to adjust the position to enter a low wind resistance zone according to the relative position of the first athlete with respect to the second athlete and the detected wind direction; and prompt the second athlete to adjust a position within the low wind resistance zone based on values detected by the at least two wind sensors disposed on or around the second athlete.

An embodiment of the disclosure provides a multiplayer sports formation arrangement prompting method adapted to monitor, by a computing device, an athlete participating in a multiplayer sport, so as to prompt the athlete to adjust a relative position with respect to a front athlete. Here, at least two wind sensors and a positioning device are disposed on the athlete. The method includes the following steps: detecting the relative position of the athlete with respect to the front athlete by using the positioning device; detecting a wind direction by using the at least two wind sensors disposed on or around the athlete; prompting the athlete to adjust a position to enter a low wind resistance zone according to the relative position of the athlete with respect to the front athlete and the detected wind direction; and prompting the athlete to adjust a position within the low wind resistance zone based on values detected by the at least two wind sensors disposed on or around the athlete.

In order to the make aforementioned and other features and advantages of the present disclosure comprehensible, embodiments accompanied with figures are described in detail below.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DETAILED DESCRIPTION

Figure 1:
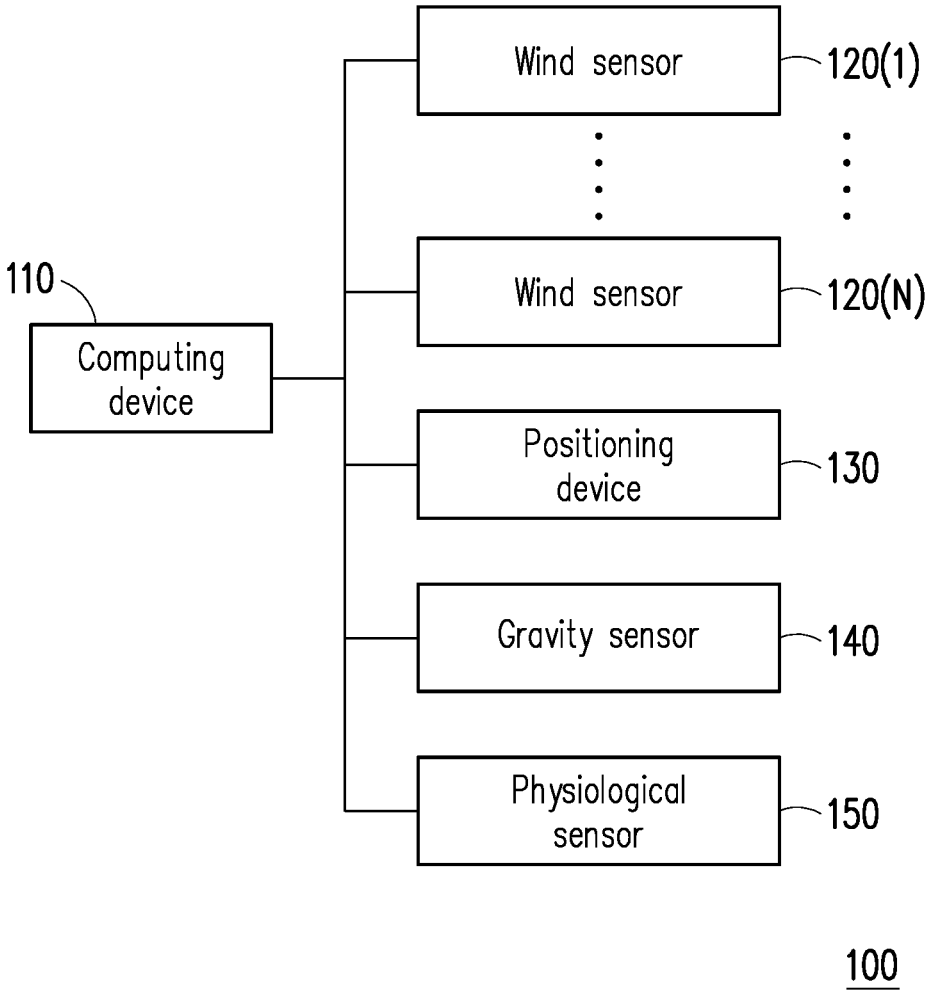
FIG. 1 is a block diagram of a multiplayer sports formation arrangement prompting system according to an exemplary embodiment of the disclosure.

The embodiments of the disclosure provide multiplayer sports formation arrangement prompting method and system, which may immediately provide data regarding position and velocity of each athlete in a sport team.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

The embodiments of the disclosure propose multiplayer sports formation arrangement prompting method and system. The method can be used to monitor various sport information for each athlete among athletes participating in a multilayer sport by using different sensors, including a wind sensor for sensing a wind direction and a wind force and a gravity sensor for sensing a moving velocity of each athlete. In another embodiment, a physiological sensor may be further included to detect a physiological condition of each athlete. By integrating the information, a low wind resistance zone of each athlete behind a leading athlete and whether to adjust a current position or not may be determined. The method and the system according to the embodiments of the disclosure are applicable to prompt a formation arrangement in the multiplayer sport including cycling, running, and roller-blading, which will be described below with reference to various embodiments.

FIG. 1 is a block diagram of a multiplayer sports formation arrangement prompting system according to an exemplary embodiment of the disclosure. With reference to FIG. 1, a multiplayer sports formation arrangement prompting system 100 according to the present embodiment of the disclosure may include a computing device 110, at least two wind sensors 120(1) to 120(N) disposed on or around each athlete participating in the multiplayer sport (one single athlete is used as an example in the description), a positioning device 130, a gravity sensor (G-sensor) 140 and a physiological sensor 150. The multiplayer sports formation arrangement prompting system 100 is applicable to a cycling team, a roller-blading team, a running team as well as friends and relatives exercising together, and the athlete may also be a normal person who exercises without particular limitations.

The computing device 110 includes, for example, a storage device and a processor (not illustrated). Here, the storage device is, for example, a random access memory (RAM), a read-only memory (ROM), a flash memory, a hard drive in any possible forms or other similar elements, or a combination of the above-mentioned elements. The processor is, for example, a central processing unit (CPU) or other programmable devices for general purpose or special purpose such as a microprocessor and a digital signal processor (DSP), a programmable controller, an application specific integrated circuit (ASIC) or other similar devices or a combination of above-mentioned devices. In this embodiment, the processor can load in a computer program to execute the multiplayer sports formation arrangement prompting method according to the embodiments of the disclosure.

The computing device 110 is, for example, connected to and communicated with the wind sensors 120(1) to 120(N), the positioning device 130, the gravity sensor 140 and the physiological sensor 150 respectively via a connection device (not illustrated) in wired or wireless manners. In terms of wired manner, the connection device may be universal serial bus (USB), RS232, universal asynchronous receiver/transmitter (UART), inter-integrated circuit (I2C), serial peripheral interface (SPI), display port, thunderbolt or local area network (LAN) interfaces, but not limited thereto. In terms of wireless manner, the connection device may be a wireless fidelity (Wi-Fi) module, a radio frequency identification (RFID) module, a Bluetooth module, an infrared module, a near-field communication (NFC) module or a device-to-device (D2D) module, but not limited thereto.

In certain embodiments, the computing device 110 may be disposed on or around each athlete of a plurality of athletes participating in a multiplayer sport or on a vehicle following the athletes. For instance, the computing device 110 may be disposed on a wearable device on each athlete or a device ridden by the athlete without particular limitations.

In certain embodiments, the wind sensors 120(1) to 120 (N), the positioning device 130, the gravity sensor 140 and the physiological sensor 150 may be disposed on or around each athlete of the athletes participating in the multiplayer sport. For instance, the wind sensors 120(1) to 120(N), the positioning device 130, the gravity sensor 140 and the physiological sensor 150 may be disposed on the wearable device of each athlete or on a sportswear of each athlete. Moreover, the wind sensors 120(1) to 120(N), the positioning device 130, the gravity sensor 140 and the physiological sensor 150 may also be disposed on the device ridden by the athlete (e.g., a bicycle) or a roller-blade of the athlete without particular limitations. Here, the wind sensors 120(1) to 120(N) may be disposed on or around each athlete. For instance, the wind sensors 120(1) to 120(N) may be symmetrically disposed on handles of the bicycle ridden by each athlete or on the wearable device of each athlete, and N may be an arbitrary number. Here, if N=2, the wind sensors 120(1) and 120(2) may be respectively disposed on a right handle and a left handle of the bicycle ridden by each athlete without particular limitations.

The wind sensors 120(1) to 120(N) may be used to detect a wind direction, and may be a flow velocity meter or a pressure gauge without particular limitations. The positioning device 130 may be used to detect relative positions of the athletes with respect to each other. Here, the positioning device 130 may be a global positioning system (GPS) or a distance sensor without particular limitations.

The gravity sensor 140 is also known as an accelerometer, an acceleration sensor, etc., which is a device for measuring acceleration and can measure their own motions (acceleration in the direction of the three axes (X-axis, Y-axis, Z-axis)) and detect the moving velocity of the athlete. Here, the gravity sensor 140 may be disposed on or around each athlete. For instance, the gravity sensor 140 may be disposed on a belt of each athlete. The physiological sensor 150 may be an electromyography sensor (EMG sensor), a heart rate sensor, a blood pressure sensor, a blood oxygen sensor, a body temperature sensor or a respiratory sensor, etc., which can detect a physiological condition of the athlete to transmit information regarding the physiological condition to the computing device 110 without particular limitations.

In certain embodiments, the multiplayer sports formation arrangement prompting system 100 further includes a remote server (not illustrated). The remote server is, for example, a cloud storage device or a cloud server, wherein the remote server can store, for example, various environmental information. Accordingly, the computing device 110 can communicate with the remote server via a network to search for the environmental information for the athletes participating in the multiplayer sport. Here, the environmental information may be a slope, a temperature, or a humidity of an athletic track, etc.

Figure 2:
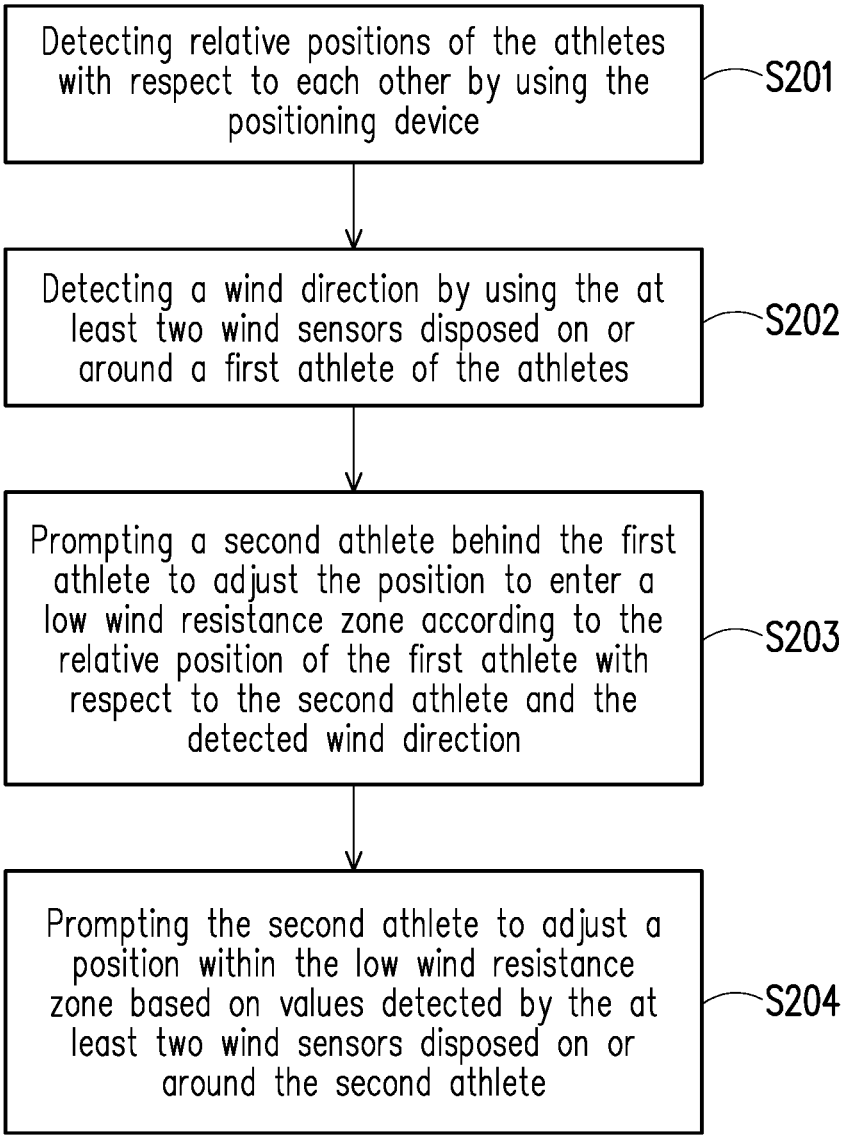
FIG. 2 is a flowchart of a multiplayer sports formation arrangement prompting method according to an exemplary embodiment of the disclosure.

FIG. 2 is a flowchart of a multiplayer sports formation arrangement prompting method according to an exemplary embodiment of the disclosure. Referring to FIG. 1 and FIG. 2 together, the method of this embodiment is adapted to the multiplayer sports formation arrangement prompting system 100 of FIG. 1, and detailed steps in the multiplayer sports formation arrangement prompting method in this embodiment of the disclosure will be described below with reference to operating relations between the devices in the multiplayer sports formation arrangement prompting system 100.

First, in step S201, the computing device 110 can detect relative positions of the athletes with respect to each other by using the positioning device 130. Here, the computing device 110 collects, for example, a geographic position detected by the positioning device 130 on or around each athlete, which is then used to calculate the relative positions of the athletes with respect to each other.

Next, in step S202, the computing device 110 can detect a wind direction by using the at least two wind sensors 120(1) to 120(N) disposed on or around a first athlete of the athletes, In step S203, the computing device 110 can prompt a second athlete behind the first athlete to adjust the position to enter a low wind resistance zone according to the relative position of the first athlete with respect to the second athlete and the detected wind direction. For instance, if the first athlete is located right in front of the second athlete there behind and the wind direction is from a front-right side of the first athlete to a rear-left side of the first athlete, the computing device 110 prompts the second athlete to adjust the position to enter the low wind resistance zone at the rear-left side of the first athlete.

Next, in step S204, the computing device 110 can prompt the second athlete to adjust a position within the low wind resistance zone based on values detected by the at least two wind sensors 120(1) to 120(N) disposed on or around the second athlete. The computing device 110 can prompt the second athlete within the low wind resistance zone to move to the left or to the right to be adjusted to an optimized position (with the smallest wind resistance) according to a wind force of the wind flowing to a front-right side of the second athlete and a wind force of the wind flowing to a front-left side of the second athlete. The other athletes behind the second athlete may also adjust the position and adjust the position within the low wind resistance zone after entering the low wind resistance zone in the same way.

With the above steps, the multiplayer sports formation arrangement prompting system 100 according to the present embodiment of the disclosure may immediately prompt each athlete of the athletes participating in the multiplayer sport to adjust the position to the low wind resistance zone, so as to improve the efficiency of each athlete in the team of the multiplayer sport.

Further, various usage scenarios of the multiplayer sports formation arrangement prompting system 100 according to the present embodiment of the disclosure are described as follows. With a bicycle riding exercise as an example, the multiplayer sports formation arrangement prompting system 100 uses, for example, two wind sensors (e.g., the first wind sensor 120(1) and the second wind sensor 120(2)) symmetrically disposed on or around the athlete.

Figure 3:
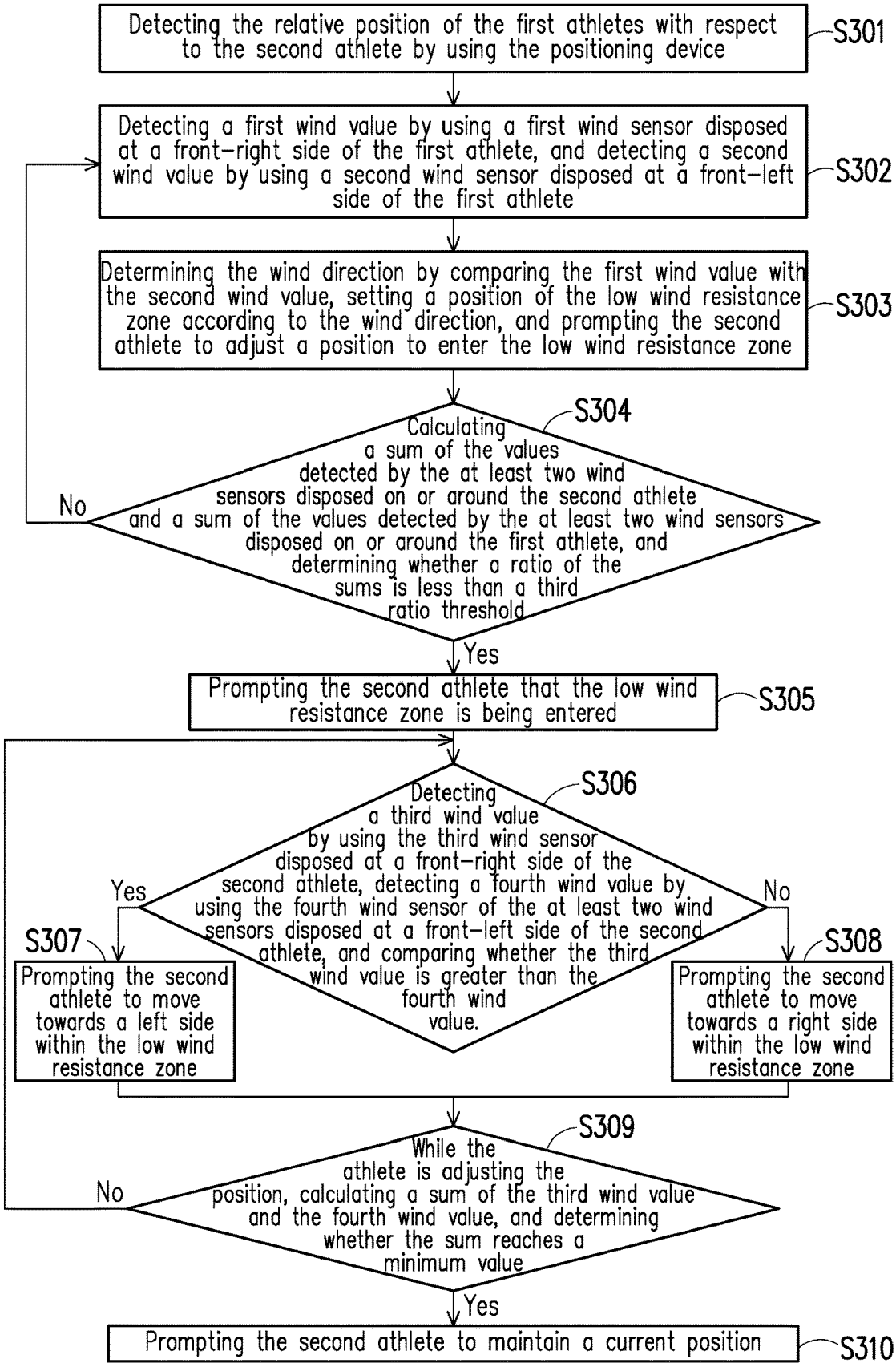
FIG. 3 is a flowchart of a multiplayer sports formation arrangement prompting method according to another exemplary embodiment of the disclosure.
Figure 4A:
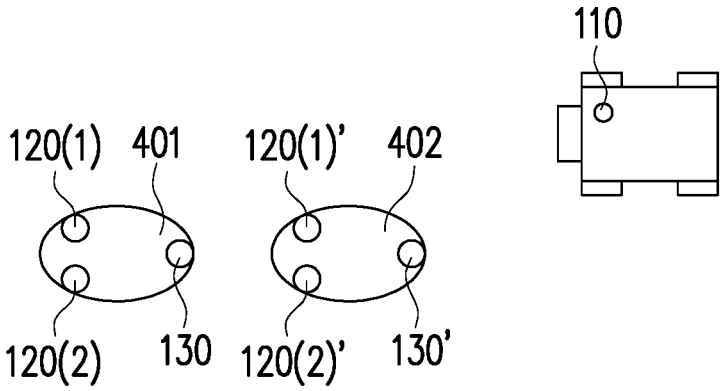
FIGS. 4A to 4C are schematic diagrams illustrating a multiplayer sports formation arrangement according to an exemplary embodiment of the disclosure.
Figure 4B:
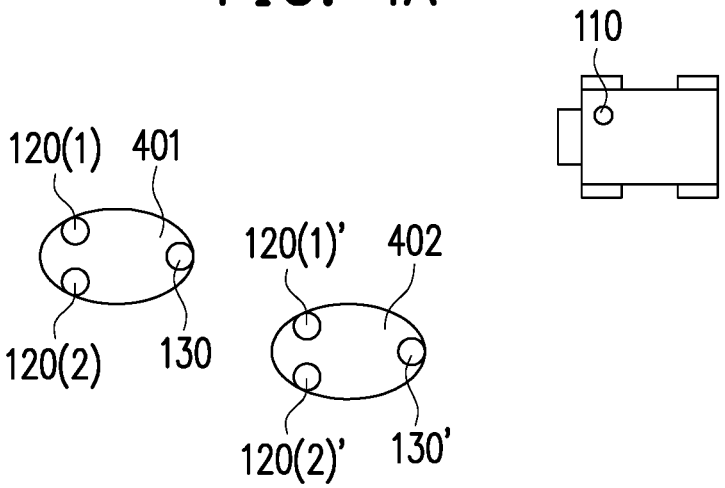
Figure 4C:
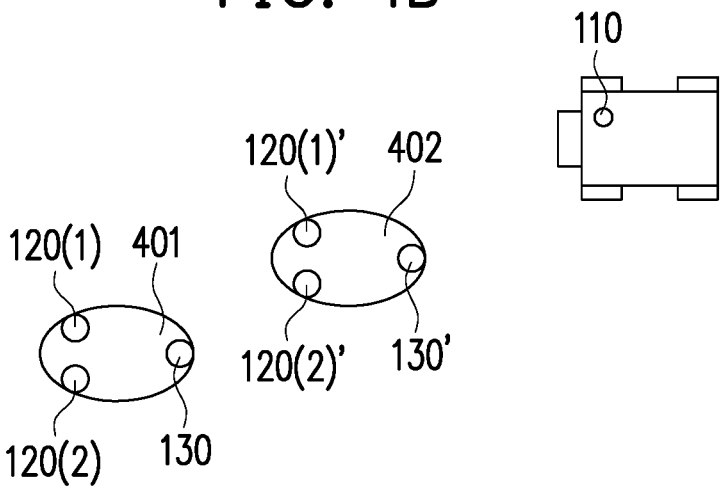

For instance, FIG. 3 is a flowchart of a multiplayer sports formation arrangement prompting method according to another exemplary embodiment of the disclosure, and FIG. 4A to FIG. 4C are schematic diagrams illustrating a multiplayer sports formation arrangement according to an exemplary embodiment of the disclosure. Referring to FIG. 3 and FIG. 4A together, first, in step S301, the computing device 110 can detect the relative positions of a first athlete 401 and a second athlete 402 with respect to each other by using the positioning devices 130 and 130' (e.g., the positioning devices 130 and 130' are respectively disposed on or around the first athlete 401 and the second athlete 402). The computing device 110 can detect that the athlete 401 is located in front of the athlete 402 by using the positioning devices 130 and 130'.

Next, in step S302, the computing device 110 can detect a first wind value by using the first wind sensor 120(1) at a front-right side of the first athlete 401 and detect a second wind value by using the second wind sensor 120(2) disposed at a front-left side of the first athlete 401. In step S303, the computing device 110 can determine a wind direction by comparing the first wind value with the second wind value, and set a position of the low wind resistance zone according to the wind direction, and prompt the second athlete 402 to adjust a position to enter the low wind resistance zone.

The computing device 110 can compare a ratio between the first wind value and the second wind value with a first ratio threshold and a second ratio threshold, respectively. In an embodiment, if the ratio is less than or equal to the first ratio threshold and greater than or equal to the second ratio threshold, the computing device 110 can set a rear zone of the first athlete 401 as the low wind resistance zone. Since the second athlete 402 is already located at a rear side of the first athlete 401 at the time, the computing device 110 will not prompt the second athlete 402 to move towards the low wind resistance zone, but can prompt the second athlete to maintain a current position.

Referring to FIG. 4B, if the ratio is greater than the first ratio threshold, the computing device 110 can set a rear-left zone of the first athlete 401 as the low wind resistance zone, and prompt the second athlete 402 to move towards the low wind resistance zone. Referring to FIG. 4C, if the ratio is less than the second ratio threshold, the computing device 110 can set a rear-right zone of the first athlete 401 as the low wind resistance zone, and prompt the second athlete 402 to move towards the low wind resistance zone. Here, the first ratio threshold is a value greater than 1, and the second ratio threshold is a value less than 1.

Referring to FIG. 3 again, in step S304, the computing device 110 can calculate a sum of the values detected by the at least two wind sensors disposed on or around the second athlete 402 and a sum of the values detected by the at least two wind sensors disposed on or around the first athlete 401, and determine whether a ratio of the sums is less than a third ratio threshold. Here, the third ratio threshold is a value less than 1. The computing device 110 can calculate the sum of the values detected by a third wind sensor 120(1)' and a fourth wind sensor 120(2)' and the sum of the values detected by the first wind sensor 120(1) and the second wind sensor 120(2), calculate the ratio of the sums, and determine whether the ratio is less than the third ratio threshold. If the ratio of the sums is less than the third ratio threshold, the process proceeds to step S305. If the ratio of the sums is not less than the third ratio threshold, the process returns to step S302.

In step S305, the computing device 110 can prompt the second athlete 402 that the low wind resistance zone is being entered. In step S306, the computing device 110 can detect a third wind value by using the third wind sensor 120(1)' disposed at a front-right side of the second athlete 402, detect a fourth wind value by using the fourth wind sensor 120(2)' of the at least two wind sensors disposed at a front-left side of the second athlete, and compare whether the third wind value is greater than the fourth wind value. In other words, the computing device 110 can compare the third wind value detected by the third wind sensor 120(1)' with the fourth wind value detected by the fourth wind sensor 120(2)', that is, to compare whether the third wind value is greater than the fourth wind value. If the third wind value is greater than the fourth wind value, the process proceeds to step S307. If the third wind value is not greater than the fourth wind value, the process proceeds to step S308.

In step S307, the computing device 110 can prompt the second athlete 402 to move towards a left side within the low wind resistance zone. In step S308, the computing device 110 can prompt the second athlete 402 to move towards a right side within the low wind resistance zone.

In step S309, the computing device 110 can calculate a sum of the third wind value and the fourth wind value, and determine whether the sum of the wind values reaches a minimum value. Whenever the second athlete 402 moves to the left or the right within the low wind resistance zone, the computing device 110 will calculate the sum of the third wind value and the fourth wind value, and determine whether the sum of the wind values reaches the minimum value after the movement. For instance, when the second athlete 402 moves towards the left side within the low wind resistance zone, if the computing device 110 determines that the sum of the wind values is gradually decreased and then gradually increased (in this case, the minimum value of the sum of the wind values may be confirmed), so as the second athlete 402 may be prompted to move to the right within the low wind resistance zone until the sum of the wind values reaches the minimum value. Here, if the minimum value is being reached, the process proceeds to step S310; if the minimum value is not being reached, the process returns to step S306.

Accordingly, in step S310, the computing device 110 can prompt the second athlete 402 to maintain a current position. Otherwise, the computing device 110 may continue to execute step S306 and the subsequent steps until the sum of the wind values reaches the minimum value in step S309.

The multiplayer sports formation arrangement prompting method according to the present exemplary embodiment is also applicable to more than two athletes participating in the multiplayer sport, in which the athletes behind the second athlete may adjust the position with the same method used by the second athlete.

With the above steps, the multiplayer sports formation arrangement prompting method according to the embodiment of the disclosure can prompt the other athletes behind the first athlete to move to the low wind resistance zone and move within the low wind resistance zone to reduce the wind resistance to the lowest to thereby improve the efficiency of each athlete in the team of the multiplayer sport.

Figure 5:
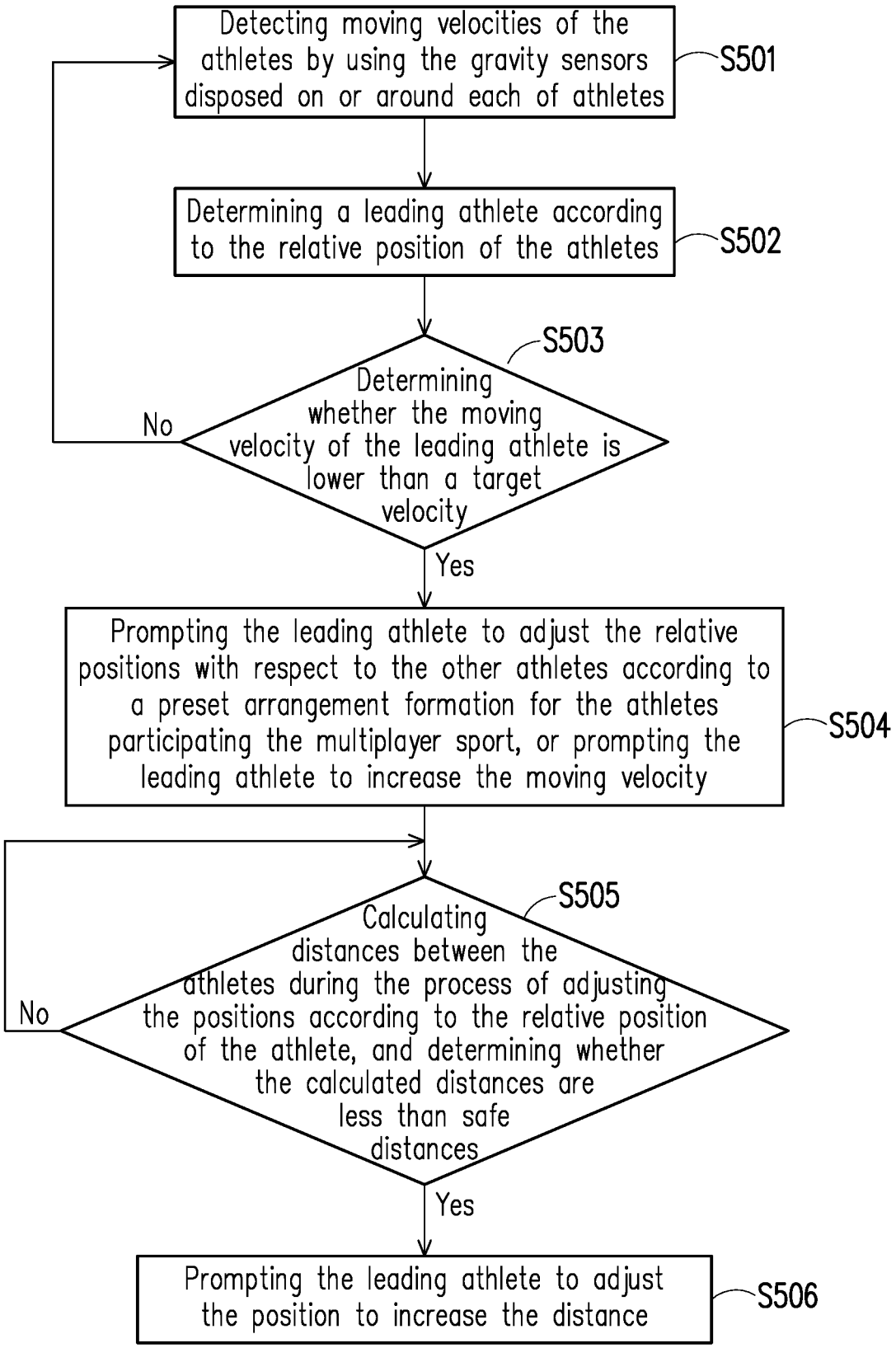
FIG. 5 is a flowchart of a multiplayer sports formation arrangement prompting method according to another exemplary embodiment of the disclosure.
Figure 6A:
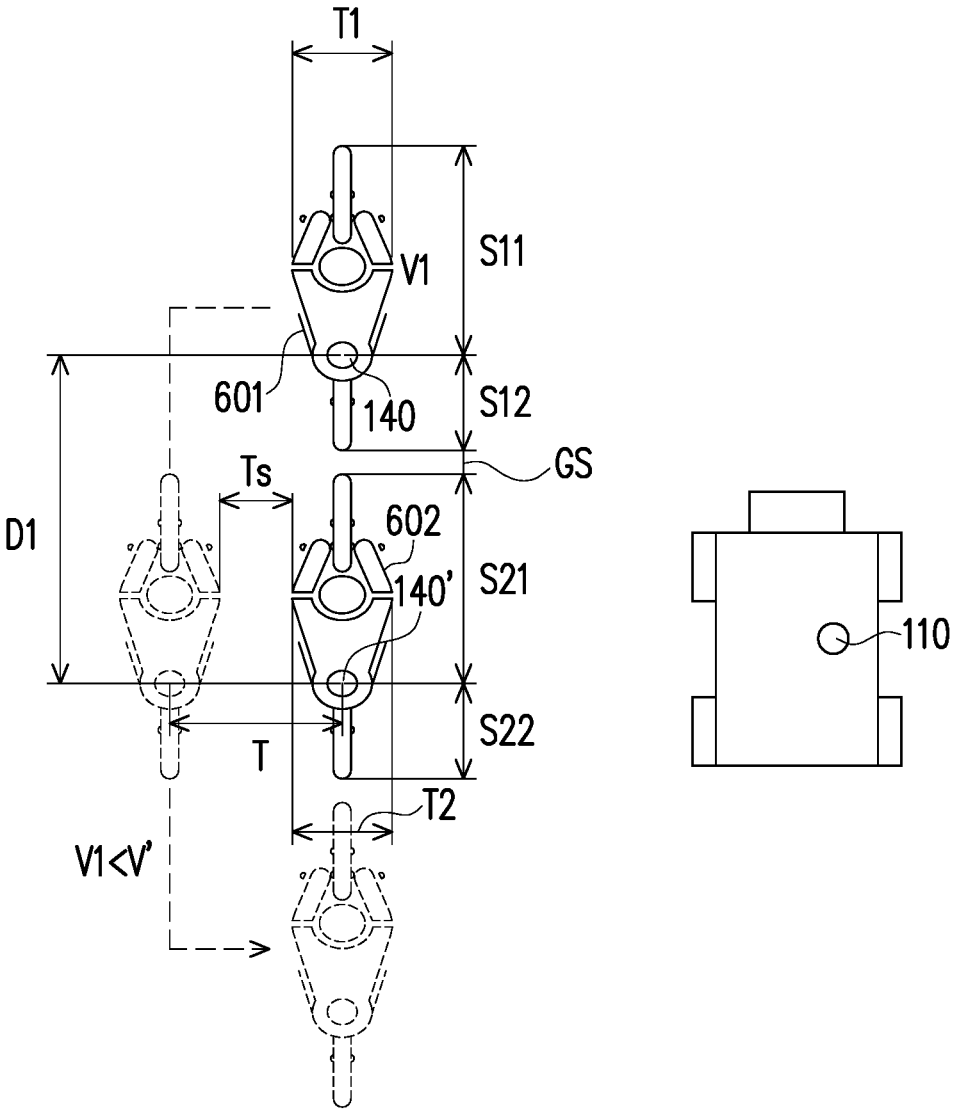
FIGS. 6A to 6C are schematic diagrams illustrating how the leading athlete adjusts the position according to an exemplary embodiment of the disclosure.
Figure 6B:
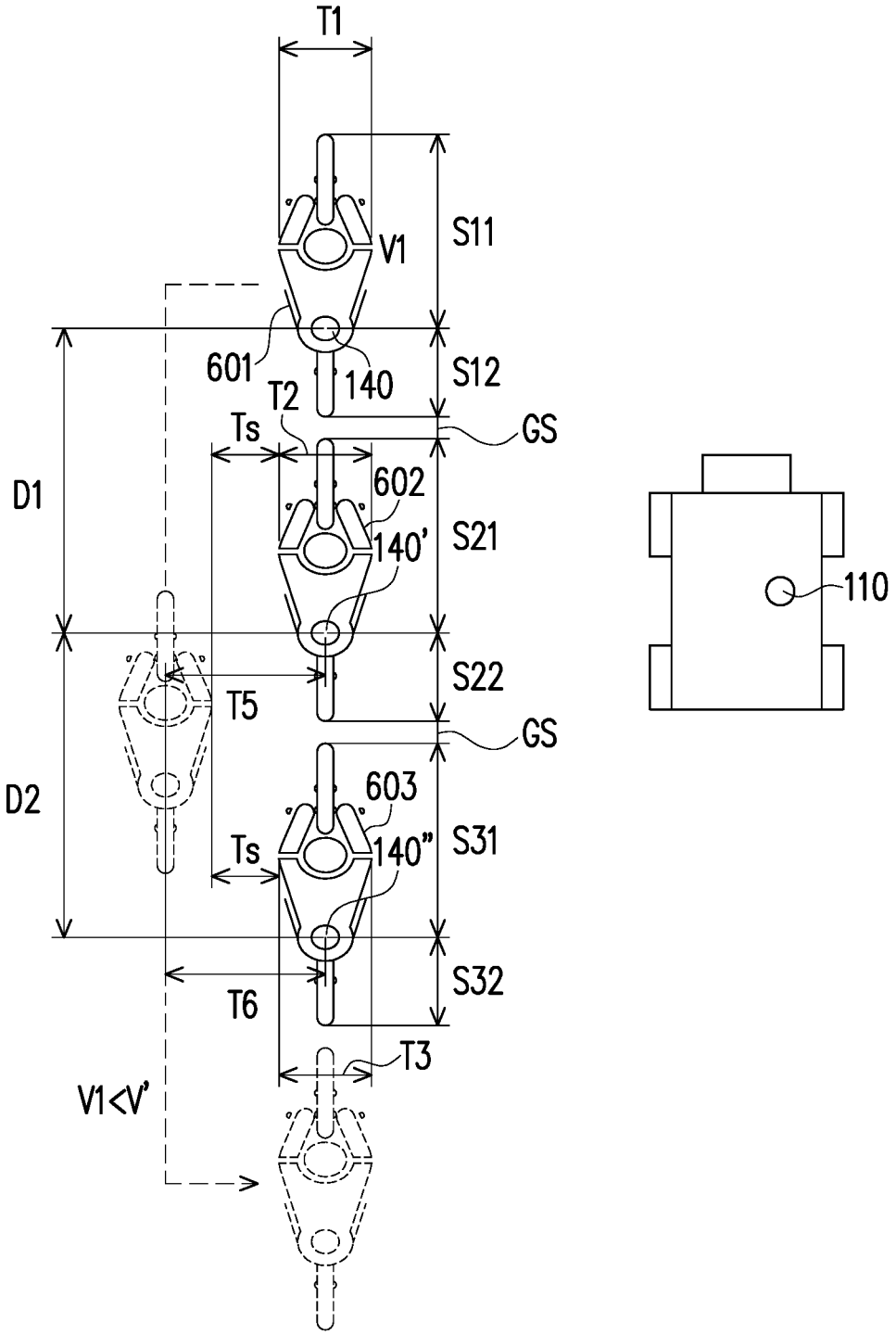
Figure 6C:
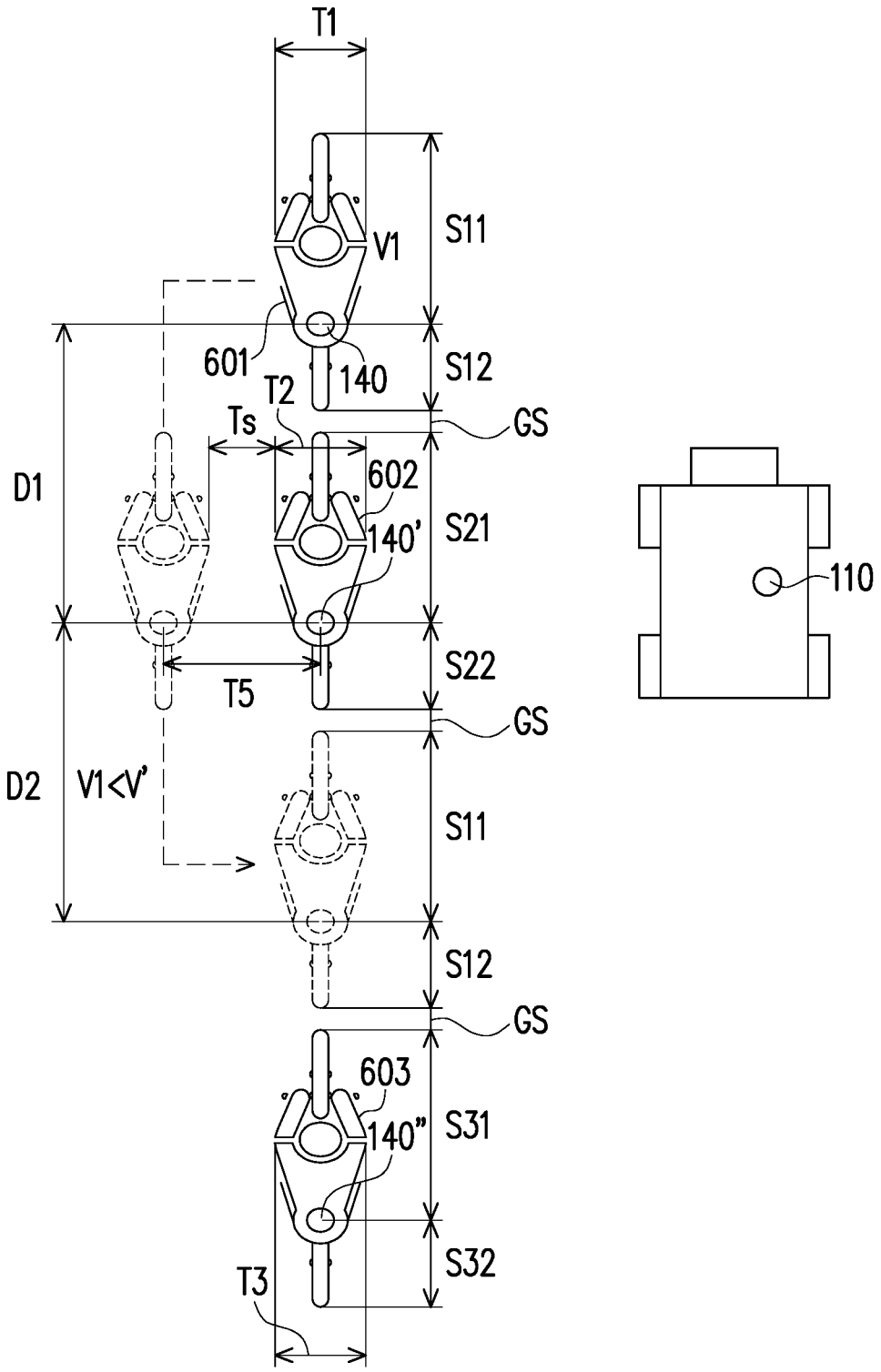

FIG. 5 is a flowchart of a multiplayer sports formation arrangement prompting method according to another exemplary embodiment of the disclosure, and FIG. 6A to FIG. 6C are schematic diagrams illustrating a multiplayer sports formation arrangement according to an exemplary embodiment of the disclosure. Referring to FIG. 5 and FIG. 6A, first, in step S501, the computing device 110 can detect moving velocities V1 and V2 of the athletes by using the gravity sensors 140 and 140' disposed on or around each of the athletes 601 and 602 (e.g., the gravity sensors 140 and 140' may be respectively disposed on or around the athlete 601 and the athlete 602 to detect the moving velocity V1 of the athlete 601 and the moving velocity V2 of the athlete 602).

Next, in step S502, the computing device 110 can determine a leading athlete 601 according to the relative position of the athletes 601 and 602. In step S503, the computing device 110 can determine whether the moving velocity V1 of the leading athlete 601 is lower than a target velocity V'. The computing device 110 can detect position information by using the positioning devices 130 (that is, the positioning device 130 shown in FIG. 1) disposed on the athletes 601 and 602, transmit the position information to the remote server so the remote server can obtain the environmental information of the athletes 601 and 602 according to the position information and transmit the environmental information to the computing device 110 for the computing device 110 to calculate the target velocity V' of the leading athlete 601. If the moving velocity V1 is lower than the target velocity V', the process proceeds to step S504. If the moving velocity V1 is not lower than the target velocity V', the process returns to step S501.

In step S504, the computing device 110 can prompt the leading athlete 601 to adjust the relative positions with respect to the second athlete 602 according to a preset arrangement formation for the athletes 601 and 602 participating in the multiplayer sport, or prompt the leading athlete 601 to increase the moving velocity V1. For instance, the athletes 601 and 602 or followers on the vehicle following the athletes can preset the arrangement formation of the athletes 601 and 602 participating in the multiplayer sport as a column formation through the computing device 110. In this way, according to the arrangement formation, the computing device 110 can prompt the leading athlete 601 to move to a rear side of the second athlete 602, or prompt the leading athlete 601 to increase the moving velocity V1.

In step S505, the computing device 110 can calculate distances between the athletes 601 and 602 during the process of adjusting the position according to the relative positions of the athletes 601 and 602, and determine whether the calculated distances are less than safe distances GS and Ts. Here, the athletes 601 and 602 or the followers on the vehicle following the athletes can preset the safe distance GS between the athletes 601 and 602 in a front-rear direction and the safe distance Ts between the athletes 601 and 602 in a left-right direction while the athletes are adjusting the positions.

For instance, the calculated distances are a distance between a rear wheel of the bicycle ridden by the leading athlete 601 and a front wheel of the bicycle ridden by the second athlete 602 and a distance between a right shoulder of the leading athlete 601 and a left shoulder of the second athlete 602, the safe distance GS may be set as a safe distance between the rear wheel of the bicycle ridden by the leading athlete 601 and the front wheel of the bicycle ridden by the second athlete 602, and the safe distance Ts may be set as a safe distance between the right shoulder of the leading athlete 601 and the left shoulder of the second athlete 602. If the calculated distances are less than the safe distances GS and Ts respectively, the process proceeds to step S506, in which the computing device 110 can prompt the leading athlete 601 to adjust the position to increase the distance. If the calculated distances are not less than the safe distances GS and Ts, the process returns to step S505, in which the distances between the athletes 601 and 602 are continuously monitored.

In an embodiment, whether a front-rear distance D1 between the center of gravity of the leading athlete 601 and the center of gravity of the second athlete 602 is safe may be further determined according to an expression below:

$$1.1\times(S12+S21+GS)>D1>(S12+S21+GS) \quad (1)$$

In the expression (1) above, S12 is a distance from the center of gravity of the leading athlete 601 to the rear wheel of the ridden bicycle, S21 is a distance from the center of gravity of the second athlete 602 to the front wheel, and GS is the safe distance described above.

In an embodiment, whether a left-right distance T between the center of gravity of the leading athlete 601 and the center of gravity of the second athlete 602 is safe may be further determined according to an expression below:

$$T>(T1+T2)/2+Ts \quad (2)$$

In the expression (2) above, T1 is a shoulder width of the leading athlete 601, T2 is a shoulder width of the second athlete 602, and Ts is the safe distance described above.

In the expressions (1) and (2), positions of the centers of gravity of the athletes 601 and 602 on the bicycles and lengths of the bicycles of the athletes 601 and 602 may be preset by the athletes 601 and 602 or the followers on the vehicle following the athletes. When the front-rear distance D1 does not satisfy the expression (1) or the left-right direction T does not satisfy the expression (2), the computing device 110 prompts the leading athlete 601 to adjust the position so that the front-rear distance D1 satisfies the expression (1) or the left-right direction T satisfies the expression (2).

Referring to FIG. 6B, when the athletes participating in the multiplayer sport include three or more than three athletes, a gravity sensor 140" may also be disposed on or around a third athlete 603 to detect a moving velocity of the third athlete 603. Whether the front-rear distance D1 between the center of gravity of the leading athlete 601 and the center of gravity of the second athlete 602 and a front-rear distance D2 between the center of gravity of the second athlete 602 and a center of gravity of the third athlete 603 are safe may be further determined by expressions below:

$$1.1\times(S12+S21+GS)\geq D1\geq(S12+S21+GS) \quad (3)$$

$$1.1\times(S22+S31+GS)\geq D2\geq(S22+S31+GS) \quad (4)$$

In the expressions (3) and (4) above, S12 is a distance from the center of gravity of the leading athlete 601 to the rear wheel of the ridden bicycle, S22 is a distance from the center of gravity of the second athlete 602 to the rear wheel of the ridden bicycle, S21 is the distance from the center of gravity of the second athlete 602 to the front wheel of the ridden bicycle, S31 is the distance from the center of gravity of the third athlete 603 to the front wheel of the ridden bicycle, GS is the safe distance between the rear wheel of the bicycle ridden by the leading athlete 601 and the front wheel of the bicycle ridden by the second athlete 602 and the safe distance between the rear wheel of the bicycle ridden by the second athlete 602 and the front wheel of the bicycle ridden by the third athlete 603. In addition, S32 shown in FIG. 6B is a distance from the center of gravity of the third athlete 603 to the rear wheel of the ridden bicycle.

In an embodiment, when the athletes participating in the multiplayer sport include three or more than three athletes, during the process in which the leading athlete 601 moves to a rear side of the third athlete 603, whether a left-right distance T5 between the center of gravity of the lading athlete 601 and the center of gravity of the second athlete 602 and a left-right distance T6 between the center of gravity of the lading athlete 601 and the center of gravity of the third athlete 603 are safe may be determined by expressions below:

$$1.1\times(T1+T2)/2+Ts\geq T5\geq(T1+T2)/2+Ts \quad (5)$$

$$1.1\times(T1+T3)/2+Ts\geq T6\geq(T1+T3)/2+Ts \quad (6)$$

In the expressions (5) and (6) above, T1 is a shoulder width of the leading athlete 601, T2 is a shoulder width of the second athlete 602, T3 is a shoulder width of the third athlete 603, Ts is a safe distance between a right shoulder of the leading athlete 601 and a left shoulder of the second athlete 602, and a safe distance between the right shoulder of the leading athlete 601 and a left shoulder of the third athlete 603.

In the expressions (3) to (6) above, positions of the centers of gravity of the athletes 601 to 603 on the bicycles, lengths of the bicycles of the athletes 601 to 603 and the safe distance GS between the rear wheel of the bicycle ridden by the second athlete 602 and the front wheel of the bicycle ridden by the third athlete 603 may all be preset by the athletes 601 to 603 or the followers on the vehicle following the athletes. When the front-rear distance D1 does not satisfy the expression (3), the computing device 110 prompts the leading athlete 601 to adjust the position so that the front-rear distance D1 satisfies the expression (3). When the front-rear distance D2 does not satisfy the expression (4), the computing device 110 prompts the athletes 602 and 603 to adjust the positions so that the front-rear distance D2 satisfies the expression (4). When the left-right distances T5 and T6 do not satisfy the expressions (5) and (6), the computing device 110 prompts the leading athlete 601 to adjust the position so that the left-right distances T5 and T6 satisfy the expressions (5) and (6).

Referring to FIG. 6C, FIG. 6C differs from FIG. 6B in that the leading athlete 601 of FIG. 6C is adjusted to a rear side of the second athlete 602 (i.e., the second last position), and the third athlete 603 is adjusted to a rear side of the athlete 601 who has adjusted the position. Here, the safe distance between the athletes 602 and 603 in the front-rear direction may be preset by the athletes 601 to 603 or the followers on the vehicle following the athletes.

In an embodiment, whether the front-rear distance D1 between the center of gravity of the leading athlete 601 and the center of gravity of the second athlete 602 and the front-rear distance D2 between the center of gravity of the second athlete 602 and the center of gravity of the leading athlete 601 moved to the rear side of the second athlete 602 are safe may be further determined by expressions below:

$$1.1\times(S12+S21+GS)\geq D1\geq(S12+S21+GS) \quad (7)$$

$$1.1\times(S22+S11+GS)\geq D2\geq(S22+S11+GS) \quad (8)$$

In the expressions (7) and (8) above, S11 is a distance from the center of gravity of the leading athlete 601 to the front wheel of the ridden bicycle, S12 is the distance from the center of gravity of the leading athlete 601 to the rear wheel of the ridden bicycle, S22 is a distance from the center of gravity of the second athlete 602 to the rear wheel of the ridden bicycle, S21 is the distance from the center of gravity of the second athlete 602 to the front wheel of the ridden bicycle, GS is the safe distance between the rear wheel of the bicycle ridden by the leading athlete 601 and the front wheel of the bicycle ridden by the second athlete 602 and the safe distance between the rear wheel of the bicycle ridden by the second athlete 602 and the front wheel of the bicycle ridden by the leading athlete 601 moved to the rear side of the second athlete 602. In addition, S32 shown in FIG. 6C is a distance from the center of gravity of the third athlete 603 to the rear wheel of the ridden bicycle.

In an embodiment, during the process in which the leading athlete 601 moves to a position between the second athlete 602 and the third athlete 603, the left-right distance T5 between the center of gravity of the leading athlete 601 and the center of gravity of the second athlete 602 may further satisfy the expression (5) above.

In the expressions (7) and (8) above, positions of the centers of gravity of the athletes 601 and 602 on the bicycles, lengths of the bicycles of the athletes 601 and 602 and the safe distance GS between the rear wheel of the bicycle ridden by the second athlete 602 and the front wheel of the bicycle ridden by the leading athlete 601 moved to the rear side of the second athlete 602 may all be preset by the athletes 601 and 602 or the followers on the vehicle following the athletes. When the front-rear distance D1 does not satisfy the expression (7), the computing device 110 prompts the leading athlete 601 to adjust the position so that the front-rear distance D1 satisfies the expression (7). When the front-rear distance D2 does not satisfy the expression (8), the computing device 110 prompts the leading athlete 601 moved to the rear side of the second athlete 602 to adjust the position so that the front-rear distance D2 satisfies the expression (8). When the left-right distance T5 does not satisfy the expressions (5), the computing device 110 prompts the leading athlete 601 in the movement to adjust the position so that the left-right distance T5 satisfies the expression (5).

With the above steps, the multiplayer sports formation arrangement prompting method according to the embodiment of the disclosure may immediately inform the leading athlete to increase or decrease the moving velocity, whether to adjust the position to the last position or the second last position (in general, since the last one of the athletes participating in the multiplayer sport is usually the team leader or the sprinter, the leading athlete who cannot maintain the target velocity may be reminded to move to the second last position) and the safe distance required during the process of adjusting the position in order to adjust the physical strength of the leading athlete.

Figure 7:
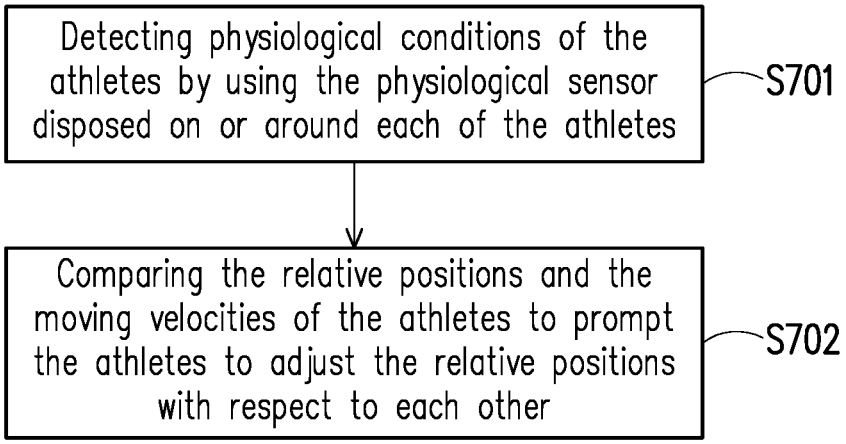
FIG. 7 is a flowchart of a multiplayer sports formation arrangement prompting method according to another exemplary embodiment of the disclosure.

FIG. 7 is a flowchart of a multiplayer sports formation arrangement prompting method according to another exemplary embodiment of the disclosure. Referring to FIG. 1, FIGS. 6B to 6C and FIG. 7 together, first, in step S701, the computing device 110 can further detect physiological conditions of the athletes by using the physiological sensor 150 disposed on or around each of the athletes 601 to 603. Next, in step S702, the computing device 110 can compare the relative positions and the physiological conditions of the athletes 601 to 603 to prompt the athletes 601 to 603 to adjust the relative positions with respect to each other. For instance, if the physiological sensor 150 on the leading athlete 601 detects that the physiological condition of the leading athlete 601 is poor, the computing device 110 can remind the leading athlete 601 to move and be the last one (e.g., as shown by FIG. 6B) or the second last one (e.g., as shown by FIG. 6C) of the athletes participating in the multiplayer sport. In this way, the wind resistance may be reduced for the leading athlete 601 to save the physical strength of the leading athlete 601.

With the steps above, the multiplayer sports formation arrangement prompting method according to the embodiment of the disclosure may immediately provide information regarding the poor physical state of the leading athlete to the leading athlete so the leading athlete can move and be the last one or the second last one of the athletes participating in the multiplayer sport.

Figure 8:
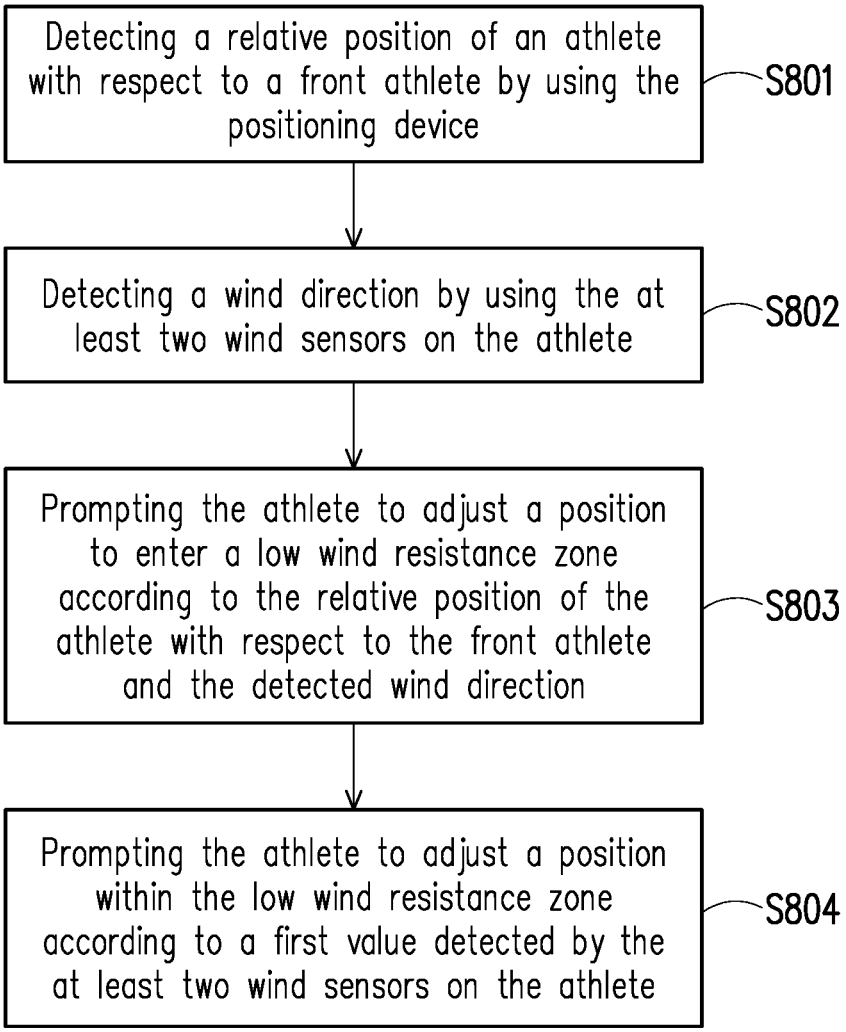
FIG. 8 is a flowchart of a multiplayer sports formation arrangement prompting method according to another exemplary embodiment of the disclosure.

FIG. 8 is a flowchart of a multiplayer sports formation arrangement prompting method according to another exemplary embodiment of the disclosure. Referring to FIG. 1 and FIG. 8 together, the method of this embodiment is adapted to the multiplayer sports formation arrangement prompting system 100 of FIG. 1, and detailed steps in the multiplayer sports formation arrangement prompting method in this embodiment of the disclosure will be described below with reference to operating relations between the devices in the multiplayer sports formation arrangement prompting system 100.

First, in step S801, the computing device 110 can detect a relative position of an athlete with respect to a front athlete by using the positioning device 130. In step S802, the computing device 110 can detect a wind direction by using the at least two wind sensors 120(1) to 120(N) on the athlete. In step S803, the computing device 110 can prompt the athlete to adjust a position to enter a low wind resistance zone according to the relative position of the athlete with respect to the front athlete and the detected wind direction. For instance, if the front athlete is located right in front of the athlete and the wind direction is from a front-right side of the athlete to a rear-left side of the athlete, the computing device 110 prompts the athlete to adjust the position to enter the low wind resistance zone at a rear-left side of the front athlete.

In step S804, the computing device 110 can prompt the athlete to adjust a position within the low wind resistance zone according to a first value detected by the at least two wind sensors 120(1) to 120(N) on the athlete. The computing device 110 can prompt the athlete within the low wind resistance zone to move slightly to the left or the right according to the force of wind flowing towards a front-right side and the force of wind flowing towards a front-left side of the athlete.

With the above steps, the multiplayer sports formation arrangement prompting system 100 according to the embodiment of the disclosure may immediately prompt one athlete participating in the multiplayer sport to adjust the current position to the low wind resistance zone to thereby improve the efficiency of the athlete.

Figure 9:
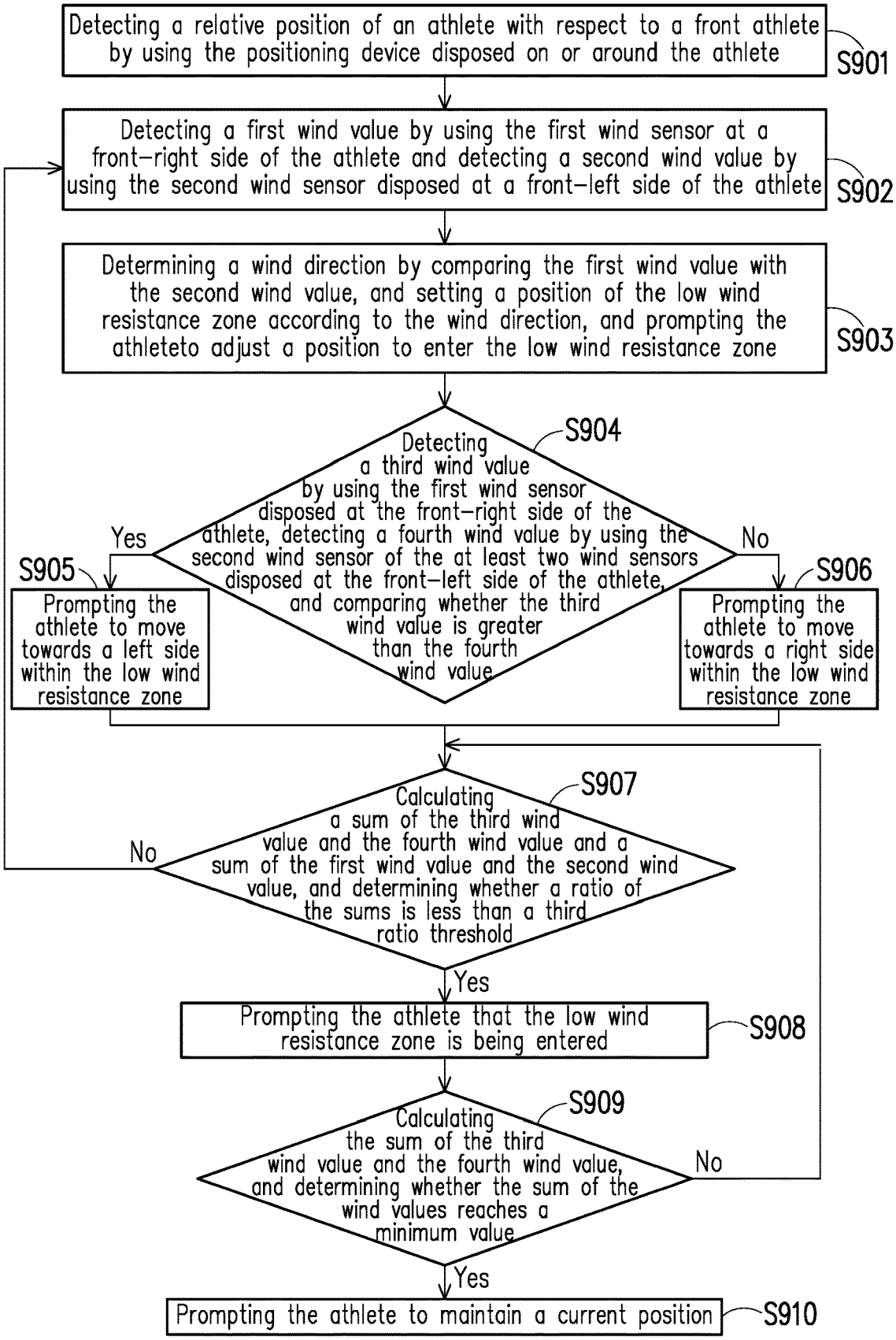
FIG. 9 is a flowchart of a multiplayer sports formation arrangement prompting method according to another exemplary embodiment of the disclosure.
Figure 10A:
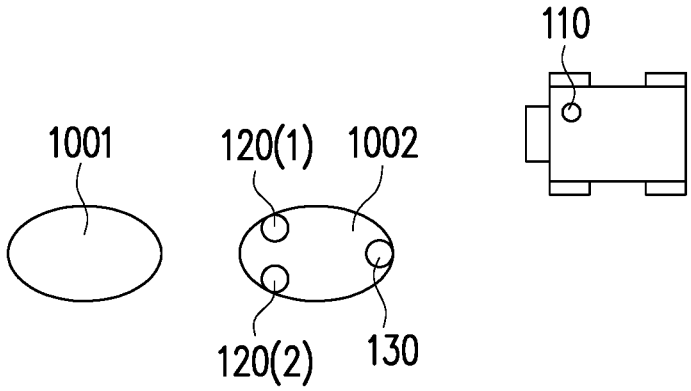
FIGS. 10A to 10C are schematic diagrams illustrating a multiplayer sports formation arrangement according to another exemplary embodiment of the disclosure.
Figure 10B:
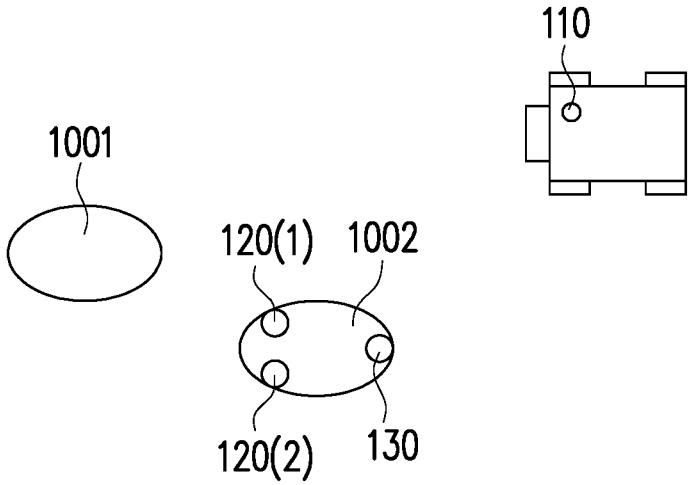
Figure 10C:
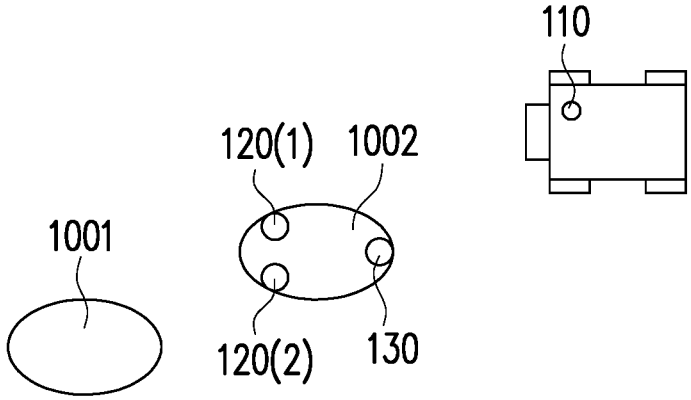

Further, FIG. 9 is a flowchart of a multiplayer sports formation arrangement prompting method according to another exemplary embodiment of the disclosure, and FIG. 10A to FIG. 10C are schematic diagrams illustrating a multiplayer sports formation arrangement according to another exemplary embodiment of the disclosure. Referring to FIG. 9 and FIG. 10A together, in step S901, the computing device 110 can detect a relative position of an athlete 1002 with respect to a front athlete 1001 by using the positioning device 130 disposed on or around the athlete 1002. The computing device 110 can detect the front athlete 1001 by using the positioning device 130 such as the distance sensor, and determine an orientation of the front athlete 1001 with respect to the athlete 1002.

In step S902, the computing device 110 can detect a first wind value by using the first wind sensor 120(1) at a front-right side of the athlete 1002 and detect a second wind value by using the second wind sensor 120(2) disposed at a front-left side of the athlete 1002. The computing device 110 can detect the first wind value of the wind blowing to the front-right side of the athlete 1002 and the second wind value of the wind blowing to the front-left side of the athlete 1002 by using the first wind sensor 120(1) and the second wind sensor 120(2), respectively.

In step S903, the computing device 110 can determine a wind direction by comparing the first wind value with the second wind value, and set a position of the low wind resistance zone according to the wind direction, and prompt the athlete 1002 to adjust a position to enter the low wind resistance zone. The computing device 110 can compare a ratio between the first wind value and the second wind value with a first ratio threshold and a second ratio threshold, respectively. In an embodiment, if the ratio is less than or equal to the first ratio threshold and greater than or equal to the second ratio threshold, a rear zone of the front athlete 1001 is set as the low wind resistance zone, and the athlete 1002 is prompted to move towards the low wind resistance zone.

Referring to FIG. 10B, if the ratio is greater than the first ratio threshold, a rear-left zone of the front athlete 1001 is set as the low wind resistance zone, and the athlete 1002 is prompted to move towards the low wind resistance zone. Referring to FIG. 10C, if the ratio is less than the second ratio threshold, a rear-right zone of the front athlete 1001 is set as the low wind resistance zone, and the athlete 1002 is prompted to move towards the low wind resistance zone. Here, the first ratio threshold is a value greater than 1, and the second ratio threshold is a value less than 1.

Referring to FIG. 9 and FIG. 10A together, in step S904, the computing device 110 can detect a third wind value by using the first wind sensor 120(1) disposed at the front-right side of the athlete 1002, detect a fourth wind value by using the second wind sensor 120(2) of the at least two wind sensors disposed at the front-left side of the athlete 1002, and compare whether the third wind value is greater than the fourth wind value. In other words, the computing device 110 can compare the third wind value detected by the first wind sensor 120(1) with the fourth wind value detected by the second wind sensor 120(2), that is, to compare whether the third wind value is greater than the fourth wind value. If the third wind value is greater than the fourth wind value, the process proceeds to step S905. If the third wind value is not greater than the fourth wind value, the process proceeds to step S906.

Accordingly, in step S905, the computing device 110 can prompt the athlete 1002 to move towards a left side within the low wind resistance zone. In step S906, the computing device 110 can prompt the athlete 1002 to move towards a right side within the low wind resistance zone.

Next, in step S907, the computing device 110 can calculate a sum of the third wind value and the fourth wind value and a sum of the first wind value and the second wind value, and determine whether a ratio of the sums is less than a third ratio threshold. Here, the third ratio threshold is a value less than 1. If the ratio of the sums is less than the third ratio threshold, the process proceeds to step S908, in which the computing device 110 can prompt the athlete 1002 that the low wind resistance zone is being entered. If the ratio of the sums is not less than the third ratio threshold, the process returns to step S902.

In step S909, the computing device 110 can calculate the sum of the third wind value and the fourth wind value, and determine whether the sum of the wind values reaches a minimum value. Each time when the athlete 1002 moves to the left or the right within the low wind resistance zone, the computing device 110 will calculate the sum of the third wind value and the fourth wind value, and determine whether the sum of the wind values reaches the minimum value after the movement. For instance, when the athlete 1002 moves towards the left side within the low wind resistance zone, if the computing device 110 determines that the sum of the wind values is gradually decreased and then gradually increased (in this case, the minimum value of the sum of the wind values may be confirmed), so as to the athlete 1002 is prompted to move to the right within the low wind resistance zone until the sum of the wind values reaches the minimum value. Here, if the minimum value is being reached, the process proceeds to step S910; if the minimum value is not being reached, the process returns to step S907.

Accordingly, in step S910, the computing device 110 can prompt the athlete 1002 to maintain a current position. Otherwise, the computing device 110 continues to execute step S907 and the subsequent steps until the sum of the wind values reaches the minimum value in step S909.

With the above steps, the multiplayer sports formation arrangement prompting method according to the embodiment of the disclosure may immediately prompt the athlete to move to the low wind resistance zone at the rear side of the front athlete to thereby improve the efficiency of the athlete.

In summary, according to the embodiments of the disclosure, the wind direction and the relative positions of the athletes with respect to each other may be detected respectively by using the wind sensors and the positioning device disposed on or around each athlete so the position of each athlete can be adjusted according to the wind direction and the relative positions. In addition, according to the embodiments of the disclosure, the gravity sensor and the physiological sensor are further used to detect the moving velocity and the physiological condition of each athlete so the relative positions of the athletes with respect to each other can be adaptively adjusted according to the moving velocity and the physiological condition. As a result, each athlete may be immediately reminded of the position of each athlete in the team and the relative position of the athletes with respect to each other.

It will be apparent to those skilled in the art that various modifications and variations can be made to the disclosed embodiments. It is intended that the specification and examples be considered as exemplary only, with a true scope of the present disclosure being indicated by the following claims and their equivalents.

The invention claimed is:

1. A multiplayer sports formation arrangement prompting method adapted to monitor, by a computing device, a formation of a plurality of athletes participating in a multiplayer sport to prompt each of the athletes to adjust a position, wherein at least two wind sensors and a positioning device are disposed on or around each of the athletes, and the method comprises:

detecting relative positions of the athletes with respect to each other by using the positioning device;

detecting a wind direction by using the at least two wind sensors disposed on or around a first athlete of the athletes;

prompting a second athlete behind the first athlete to adjust the position to enter a low wind resistance zone according to the relative position of the first athlete with respect to the second athlete and the detected wind direction; and prompting the second athlete to adjust a position within the low wind resistance zone based on values detected by the at least two wind sensors disposed on or around the second athlete.

2. The method according to claim 1, wherein the step of detecting the wind direction by using the at least two wind sensors disposed on or around the first athlete of the athletes comprises:

detecting a first wind value by using a first wind sensor of the at least two wind sensors disposed at a front-right side of the first athlete, detecting a second wind value by using a second wind sensor of the at least two wind sensors disposed at a front-left side of the first athlete, and determining the wind direction by comparing the first wind value with the second wind value.

3. The method according to claim 2, wherein the step of prompting the second athlete behind the first athlete to adjust the position to enter the low wind resistance zone according to the relative position of the first athlete with respect to the second athlete and the detected wind direction comprises:

comparing a ratio between the first wind value and the second wind value with a first ratio threshold and a second ratio threshold, respectively;

if the ratio is greater than the first ratio threshold, setting a rear-left zone of the first athlete as the low wind resistance zone, and prompting the second athlete to move towards the low wind resistance zone;

if the ratio is less than the second ratio threshold, setting a rear-right zone of the first athlete as the low wind resistance zone, and prompting the second athlete to move towards the low wind resistance zone; and if the ratio is less than or equal to the first ratio threshold and greater than or equal to the second ratio threshold, setting a rear zone of the first athlete as the low wind resistance zone, and prompting the second athlete to move towards the low wind resistance zone.

4. The method according to claim 1, wherein the step of prompting the second athlete behind the first athlete to adjust the position to enter the low wind resistance zone according to the relative position of the first athlete with respect to the second athlete and the detected wind direction comprises:

calculating a sum of the values detected by the at least two wind sensors disposed on or around the second athlete and a sum of the values detected by the at least two wind sensors disposed on or around the first athlete, and determining whether a ratio of the sums is less than a third ratio threshold; and if the ratio of the sums is less than the third ratio threshold, prompting the second athlete that the low wind resistance zone is being entered.

5. The method according to claim 1, wherein the step of prompting the second athlete to adjust a position within the low wind resistance zone based on the values detected by the at least two wind sensors disposed on or around the second athlete comprises:

detecting a third wind value by using a third wind sensor disposed at a front-right side of the second athlete, detecting a fourth wind value by using a fourth wind sensor of the at least two wind sensor disposed at a front-left side of the second athlete, and comparing the third wind value with the fourth wind value;

if the third wind value is greater than the fourth wind value, prompting the second athlete to move towards a left side within the low wind resistance zone; and if the third wind value is not greater than the fourth wind value, prompting the second athlete to move towards a right side within the low wind resistance zone.

6. The method according to claim 5, wherein the step of prompting the second athlete to adjust the position within the low wind resistance zone based on the values detected by the at least two wind sensors disposed on or around the second athlete further comprises:

while the second athlete is moving within the low wind resistance zone, calculating a sum of the third wind value and the fourth wind value, and determining whether the sum reaches a minimum value;

if the minimum value is being reached, prompting the second athlete to maintain a current position; and if the minimum value is not being reached, continuously comparing the third wind value with the fourth wind value to prompt the second athlete to adjust the position within the low wind resistance zone.

7. The method according to claim 1, further comprising:

detecting moving velocities of the athletes by using a gravity sensor disposed on or around each of the athletes; and comparing the relative positions and the moving velocities of the athletes to prompt the athletes to adjust the relative positions with respect to each other.

8. The method according to claim 7, wherein the step of comparing the relative positions and the moving velocities of the athletes to prompt the athletes to adjust the relative positions with respect to each other comprises:

determining a leading athlete according to the relative positions of the athletes;

determining whether the moving velocity of the leading athlete is lower than a target velocity; and if the moving velocity is lower than the target velocity, prompting the leading athlete to adjust the relative positions with respect to the other athletes according to a preset formation of the plurality of athletes participating in the multiplayer sport.

9. The method according to claim 7, wherein the step of comparing the relative positions and the moving velocities of the athletes to prompt the athletes to adjust the relative positions with respect to each other further comprises:

while the athletes are adjusting the positions, calculating distances between the athletes who are adjusting the positions according to the relative positions of the athletes, and determining whether the calculated distances are less than safe distances; and if the calculated distances are less than the safe distances, prompting the athletes to adjust the positions for increasing the distances.

10. The method according to claim 1, further comprising:

detecting physiological conditions of the athletes by using a physiological sensor disposed on or around each of the athletes; and comparing the relative positions and the physiological conditions of the athletes to prompt the athletes to adjust the relative positions with respect to each other.

11. A multiplayer sports formation arrangement prompting system, comprising:

at least two wind sensors and a positioning device disposed on each athlete of a plurality of athletes participating in a multiplayer sport; and a computing device, connected to and communicated with the wind sensors and the positioning device, and configured to:

detect relative positions of the athletes with respect to each other by using the positioning device;

detect a wind direction by using the at least two wind sensors disposed on or around a first athlete of the athletes;

prompt a second athlete behind the first athlete to adjust the position to enter a low wind resistance zone according to the relative position of the first athlete with respect to the second athlete and the detected wind direction; and prompt the second athlete to adjust a position within the low wind resistance zone based on values detected by the at least two wind sensors disposed on or around the second athlete.

12. The system according to claim 11, wherein the computing device detects a first wind value by using a first wind sensor of the at least two wind sensors disposed at a front-right side of the first athlete, detects a second wind value by using a second wind sensor of the at least two wind sensors disposed at a front-left side of the first athlete, and determines the wind direction by comparing the first wind value with the second wind value.

13. The system according to claim 12, wherein the computing device compares a ratio between the first wind value and the second wind value with a first ratio threshold and a second ratio threshold, respectively;

if the ratio is greater than the first ratio threshold, the computing device sets a rear-left zone of the first athlete as the low wind resistance zone, and prompts the second athlete to move towards the low wind resistance zone;

if the ratio is less than the second ratio threshold, the computing device sets a rear-right zone of the first athlete as the low wind resistance zone, and prompts the second athlete to move towards the low wind resistance zone; and if the ratio is less than or equal to the first ratio threshold and greater than or equal to the second ratio threshold, the computing device sets a rear zone of the first athlete as the low wind resistance zone, and prompts the second athlete to move towards the low wind resistance zone.

14. The system according to claim 11, wherein the computing device calculates a sum of the values detected by the at least two wind sensors disposed on or around the second athlete and a sum of the values detected by the at least two wind sensors disposed on or around the first athlete, and determines whether a ratio of the sums is less than a third ratio threshold; and if the ratio of the sums is less than the third ratio threshold, the computing device prompts the second athlete that the low wind resistance zone is being entered.

15. The system according to claim 11, wherein the computing device detects a third wind value by using a third wind sensor disposed at a front-right side of the second athlete, detects a fourth wind value by using a fourth wind sensor of the at least two wind sensor disposed at a front-left side of the second athlete, and compares the third wind value with the fourth wind value;

if the third wind value is greater than the fourth wind value, the computing device prompts the second athlete to move towards a left side within the low wind resistance zone; and if the third wind value is not greater than the fourth wind value, the computing device prompts the second athlete to move towards a right side within the low wind resistance zone.

16. The system according to claim 15, wherein while the second athlete is moving within the low wind resistance zone, the computing device calculates a sum of the third wind value and the fourth wind value, and determines whether the sum reaches a minimum value;

if the minimum value is being reached, the computing device prompts the second athlete to maintain a current position; and if the minimum value is not being reached, the computing device continuously compares the third wind value with the fourth wind value to prompt the second athlete to adjust the position within the low wind resistance zone.

17. The system according to claim 11, further comprising: a gravity sensor disposed on or around each of the athletes, wherein the computing device detects moving velocities of the athletes by using the gravity sensor; and the computing device compares the relative positions and the moving velocities of the athletes to prompt the athletes to adjust the relative positions with respect to each other.

18. The system according to claim 17, wherein the computing device determines a leading athlete according to the relative positions of the athletes;

the computing device determines whether the moving velocity of the leading athlete is lower than a target velocity; and if the moving velocity is lower than the target velocity, the computing device prompts the leading athlete to adjust the relative positions with respect to the other athletes according to a preset formation of the plurality of athletes participating in the multiplayer sport.

19. The system according to claim 17, wherein while the athletes are adjusting the positions, the computing device calculates distances between the athletes who are adjusting the positions according to the relative positions of the athletes, and determines whether the calculated distances are less than safe distances; and if the calculated distances are less than the safe distances, the computing device prompts the athletes to adjust the positions for increasing the distances.

20. A multiplayer sports formation arrangement prompting method adapted to monitor, by a computing device, an athlete participating in a multiplayer sport, so as to prompt the athlete to adjust a relative position with respect to a front athlete, wherein at least two wind sensors and a positioning device are disposed on or around the athlete, and the method comprises:

detecting the relative position of the athlete with respect to the front athlete by using the positioning device;

detecting a wind direction by using the at least two wind sensors disposed on or around the athlete;

prompting the athlete to adjust a position to enter a low wind resistance zone according to the relative position of the athlete with respect to the front athlete and the detected wind direction; and prompting the athlete to adjust a position within the low wind resistance zone based on values detected by the at least two wind sensors disposed on or around the athlete.

* * * * *